US005460697A

United States Patent [19]

Akhtar et al.

[11] Patent Number: 5,460,697

[45] Date of Patent: Oct. 24, 1995

[54] METHOD OF PULPING WOOD CHIPS WITH A FUNGI USING SULFITE SALT-TREATED WOOD CHIPS

[75] Inventors: Masood Akhtar, Madison; Michael C. Attridge, McFarland; John W. Koning, Jr., Madison; T. Kent Kirk, Verona, all of Wis.

[73] Assignee: Wisconsin Alumni Research Foundation, Madison, Wis.

[21] Appl. No.: 258,140

[22] Filed: Jun. 10, 1994

Related U.S. Application Data

[63] Continuation of Ser. No. 959,002, Oct. 9, 1992, abandoned.

[51] Int. Cl.[6] ..... D21C 3/12; D21C 3/20

[52] U.S. Cl. ..... 162/72; 162/83; 435/278

[58] Field of Search ..... 162/72, 83, DIG. 12; 435/277, 278

[56] References Cited

U.S. PATENT DOCUMENTS

| | | | |
|---|---|---|---|
| 3,393,122 | 7/1968 | Marshall | 162/27 |
| 3,617,436 | 7/1968 | Sundasen | 162/DIG. 12 |
| 5,055,159 | 10/1991 | Blanchette et al. | 162/72 |

OTHER PUBLICATIONS

Akhtar, et al., "Biomechanical Pulping of Loblolly Pine Chips with Selected White–Rot Fungi," Forest Products Laboratory article (1992).

Akhtar, et al., "Biomechanical pulping or loblolly pine with different strains of the white–rot fungus *Ceriporiopsis subvermispora," Biomechanical Pulping* 105–109 (Feb. 1992 Tappi Journal).

Lamar and Dietrich, "In Situ Depletion of Pentachlorophenol from Contemainated Soil by Phanerochaete spp.," *Applied and Environmental Microbiology*, Oct. 1990, pp. 3093–3100.

Leatham, et al., "Biomechanical pulping of aspen chips: energy savings resulting from different fungal treatments," *Energy Savings*, 197–200 (May 1990 Tappi Journal).

Myers, et al., "Fungal pretreatment of aspen chips improves strength of refiner mechanical pulp," *Biopulping*, 105–108 (May 1988 Tappi Journal).

*Primary Examiner*—Steve Alvo
*Attorney, Agent, or Firm*—Quarles & Brady

[57] ABSTRACT

A method of making a wood pulp is disclosed. Wood is first chipped into wood chips. The wood chips are treated with an amount of sulfite salt sufficient to inhibit indigenous microorganism growth. The treated wood chips are introduced into a bioreactor and inoculated with a culture of white-rot fungus. The wood chips are incubated under conditions favoring the propagation of white-rot fungus and then mechanically pulped.

7 Claims, No Drawings

METHOD OF PULPING WOOD CHIPS WITH A FUNGI USING SULFITE SALT-TREATED WOOD CHIPS

This is a continuation of application Ser. No. 07/959,002 filed Oct. 9, 1992, now abandoned.

FIELD OF THE INVENTION

The present invention relates to the general field of paper manufacture. In particular, the present invention relates to the use of biological agents in conjunction with mechanical processes to produce paper pulp from sulfite salt-treated wood.

BACKGROUND

In the manufacture of paper from wood, the wood is first reduced to an intermediate stage in which the wood fibers are separated from their natural environment and transformed into pulp, a viscous liquid suspension. There are several techniques used to produce pulp from various types of wood. The simplest of these techniques is the refiner mechanical pulping (RMP) method, in which the input wood is simply ground or abraded in water through a mechanical milling operation until the fibers are of a defined desired state of freeness from each other. Other pulping methodologies include thermo-mechanical pulping (TMP), chemical treatment with thermo-mechanical pulping (CTMP), chemi-mechanical pulping (CMP) and the chemical pulping, sulfate (kraft) or sulfite processes for pulping wood. The general concept in all of these processes for creating pulp from wood is to separate the wood fibers to a desired level of freeness from the complex matrix in which they are embedded in the native wood.

Of the various components of wood, cellulose polymers are the most abundant and are the predominate molecule desired for retention in pulp for paper production. The second most abundant polymer in wood, which is the least desirable component in the pulp, is lignin. Lignin is a complex macromolecule of aromatic units with several different types of interunit linkages. In the native wood, lignin physically protects the cellulose polysaccharides in complexes known as lignocellulosics. In chemical pulping processes, lignin is removed. In chemi-mechanical processes, lignin is disrupted to free the cellulose or to make it easier to mechanically free the cellulose.

Biological systems can be utilized to assist in the pulping of wood. A desirable biological system would liberate cellulose fibers from the lignin matrix by taking advantage of the natural abilities of an organism. Research in this area has focused on white-rot fungi, so named because the characteristic appearance of infected wood is a pale color. This color is the result of the depletion of lignin in the wood, the lignin having been degraded or modified by the fungi. Because white-rot fungi appear to preferentially degrade or modify lignin, they are logical choices for biological treatment to pulp wood. Pulping by this method is referred to as biopulping.

Several attempts to create biopulping systems using white-rot fungi on a variety of wood fibers have been reported. The most commonly utilized fungus is the white-rot fungus *Phanerochaete chrysosporium,* also referred to as *Sporotrichum pulverulentum.* Other fungi which have been previously used in such procedures include fungi of the genera Polyporus and Phlebia. The prior art is generally cognizant of the fact that attempts have been made to use microorganisms, such as white-rot fungi, as part of a process of treating wood in combination with a step of either mechanical or thermo-mechanical pulping of cellulose fiber.

An example of a teaching of a method of producing cellulose pulp is shown in U.S. Pat. No. 3,962,033, directed to the biopulping of cellulose using white-rot fungi. The fungi used included both naturally occurring wild-type strain cultures and mutant strains produced which lacked cellulase, so as to reduce the amount of cellulose degraded by the organisms. Various types of wood were degraded with the fungi. This wood was then used as input materials for a thermo-chemical or thermo-mechanical pulping procedure. This patent discloses various techniques for making a cellulose pulp by depleting lignin while reducing the cellulose-decomposing action of the enzymes produced by these organisms in order to preserve the cellulose yield.

Groups working with the inventors of this patent have several publications regarding use of fungi for biomechanical pulping, e.g. Anders and Erikkson, *Svensk Papperstidning,* 18:641–2 (1975), Erikkson and Vallander *Svensk Papperstidning,* 6:85:33–38 (1982). Unfortunately, the process never gained commercial acceptance and has not been widely utilized. One difficulty is that most of the prior techniques for utilizing biological techniques for the pulping of paper have resulted in paper which has had only marginal strength increase or is weaker than papers made by more conventional process.

U.S. Pat. No. 5,055,159 discloses biopulping with *C. subvermispora.* Biomechanical pulping of both hardwood and softwood chips with this white-rot fungus has been demonstrated. During such "biopulping" a substantial amount of electrical energy (25–50%) is saved along with improvements in paper strength properties (Akhtar et al., *Holzforschung;* in press, 1992; Akhtar, et al., *Tappi J.,* 75:105–109, 1992; Blanchette et al., U.S. Pat. No. 5,055,159, 1991; Leathem, et al., *Tappi J.* 73:197–200, 1990; Meyers, et al., *Tappi J.,* 71:105–108, 1988.

However, these results were obtained with sterilized wood. Sterilization of chips prior to inoculation with the desired microorganism is essential because unsterilized wood chips carry a heavy load of unwanted indigenous microorganisms. These indigenous microorganisms germinate and grow very rapidly when chips are moistened. Some of these indigenous microorganisms not only inhibit delignification by the desired microorganisms but consume cellulose, which results in the loss of paper strength.

Methods such as autoclaving and pressurized steaming have been used to reduce the level of contaminants in wood chips. In some instances, chemicals such as methyl bromide have been used for the same purpose (Lamar, et al., *Appl. Environ. Microb.,* 56:3093–3100, 1990). These chemicals inhibit a number of indigenous microorganisms, but they may also reduce the growth of the desired organism. Moreover, these chemicals are expensive.

What is needed in the art of pulping is a method of biopulping in which unsterilized wood chips may be used.

SUMMARY OF THE INVENTION

The present invention is a method of making a wood pulp. The first step is chipping wood into chips. These wood chips are treated with an amount of sulfite salt sufficient to inhibit growth of indigenous microorganisms. The sulfite salt is one that inhibits the growth of indigenous microorganisms of the wood chips but permits the growth of white-rot fungi. The treated wood chips are introduced into a bioreactor and-inoculated with a culture of a white-rot fungus. This inoculation could take place before, during, or after the treatment of the wood chips with sodium bisulfite. The wood chips are then incubated under conditions favoring the propagation of the fungus through the wood chips for a sufficient amount of time for the fungus to modify a significant amount of the lignin in the wood chips. The incubated wood chips are then mechanically pulped into a paper pulp.

Preferably, the wood chips are either southern yellow pine or aspen. Also, preferably, the inoculum comprises *C. subvermispora* and the sulfite salt is sodium bisulfite.

The present invention is also a method of pre-treating wood comprising chipping the wood into wood chips and treating the wood chips with an amount of sulfite salt sufficient to inhibit indigenous growth of microorganisms. The sulfite salt is one that inhibits the growth of indigenous microorganisms of the wood chips but permits the growth of white-rot fungi. The present invention is also wood chips treated with sodium bisulfite.

The present invention is also a method of producing paper. Wood chips are first treated with an amount of sulfite salt sufficient to inhibit the growth of indigenous microorganism growth. These wood chips are introduced into a bioreactor and inoculated with an inoculum of a white-rot fungus. This inoculation may take place before, after, or at the same time as the treatment with sodium bisulfite. The inoculated wood chips are then incubated under conditions favorable to the propagation of the fungus through the wood chips and the incubated wood chips are mechanically pulped to create a pulp. Paper is made from this pulp.

It is an object of the present invention to produce pulps capable of making paper with sufficient strength.

It is another object of the present invention to produce paper with less expenditure of energy.

It is another object of the present invention to create pulps by biopulping with white-rot fungi.

It is another object of the present invention to create a pulp from biopulping with a suitable effluent for environmental purposes.

It is another object of the present invention to create chips that may be biopulped.

One advantage of the present invention is that pulps may be produced through biopulping from unsterilized wood chips.

Another advantage is that pulps may be produced by biopulping at a lower cost.

Other objects, features and advantages of the present invention will become apparent after examination of the specification and claims.

BRIEF DESCRIPTION OF THE INVENTION

The present invention is a method of biopulping using wood treated with sulfite salt. The sulfite salt treatment of the wood allows white-rot fungi, such as *C. subvermispora,* to propagate but inhibits the growth of harmful indigenous fungi and other microorganisms.

1. Wood Preparation

The process begins with wood chips. The process of the present invention is intended and particularly adapted for the biopulping of soft woods, such as U.S. southern pine species. A preferred species for use in the biopulping process of the present invention is Loblolly pine, *Pinus taeda,* which is a major pulpwood species. We have found that white-rot fungus has utility for hardwood species as well, such as aspen. Although the Examples below disclose the utility of the present invention with aspen chips, the present invention is envisioned as being useful in both softwoods and hardwoods. The wood is converted to chips through a conventional technology to a chip size of anywhere between ⅛ and ¾ of an inch.

Because conditions of high humidity during the fermentation process will be desired, a relatively high moisture content of the chips prior to fermentation with the biopulping fungus is most desirable. Therefore, the chip moisture content prior to inoculation is preferably at the fiber saturation point or greater. A preferred moisture content would be approximately 55–65% of the total wood. This measurement indicates that of the total weight of the moist wood, approximately 55–65% of that weight is moisture.

It is possible that nutrient amendments to the chips may be desirable to achieve the greatest efficiency in the fungal penetration of the wood chips. If such amendments are utilized, the amendment should have a relatively low component of nutrient nitrogen source, between 0% and 2% nitrogen on the basis of the dry chip weight. The preferred nitrogen content for such a chip amendment is 0.0035% (based on the moisture-free weight of the chips) plus or minus two fold. A carbon source may also be used in the chip amendment of significantly greater content, between 0% and 5% on the basis of dried chip weight, with a preferred range of approximately 2–4% of the chip amendment. Minerals or vitamins important to the nutrient needs of the fungal culture may also be supplied.

The next step in the present invention is to treat wood with a sulfite salt. The sulfite salt must be of a type that inhibits the growth of indigenous microorganisms but permits the growth of white-rot fungi. Therefore, to be suitable for the present invention, a salt must pass a two-part test. The first test determines whether the salt inhibits the growth of indigenous microorganisms. Example 2 discloses a preferable method of determining whether a given sulfite salt inhibits the growth of indigenous microorganisms. Table 2 discloses results of such a test with different chemicals. According to Table 2, sodium hydrosulfite, sodium metabisulfite, and sodium bisulfite passed the first test. Recent results indicate that other salts of sulfite, such as potassium bisulfite, also passed the first test. Other sulfite salts, such as sodium sulfite and other types of sulfur salts such as sodium sulfate did not pass the test.

The second test determines whether the salt permits the growth of white-rot fungi. Example 5 discloses a preferable method for this test. In Example 5 the effect of concentrations of sodium bisulfite was studied on the growth of several different white-rot fungi.

Preferable conditions for wood treatment are as follows: Preferably, approximately 2–2.5 kg of sulfite salt per ton of wood chips is used to treat the chips. It is preferable to treat the wood before the application of the fungi because undesirable microorganisms would not have a chance to propagate and damage the wood fiber. Additionally, amounts of sulfite salt used to treat the indigenous fungi might be too concentrated to allow the white-rot fungi to grow. It is preferable to dilute out the salt before applying the white-rot fungi.

A preferable industrial-scale application might be as follows. Chips are soaked in a sufficient concentration of sulfite salt for 15–60 minutes. This soaking might be by placing the chips on a conveyor belt and running the belt through a tank containing a sulfite salt solution. The soaked chips are then rotated through a water bath until the concentration of sulfite salt is low enough to permit white-rot fungal growth. As the chips leave the water bath, they could be sprayed with the appropriate white-rot fungi.

2. Fungi Application

Separately from the chips, a seed inoculum must be maintained of the culture to be utilized during the biopulping process. The preferred culture is the fungal species *Ceriporiopsis subvermispora,* with a preferred strain identified to date being strain CZ-3 from the Center for Forest Mycology Research of the Forest Products Laboratory. However, other strains of *Ceriporiopsis subvermispora* are also suitable for the present invention.

Strains of *Ceriporiopsis subvermispora* can be maintained by conventional fungal culture techniques, most conveniently by growing on potato dextrose agar (PDA) slants. Stock slants may routinely be prepared from an original culture for routine use and may be refrigerated until used.

Many white-rot fungi may be suitable for the present invention. Tables 6 and 7 list fungi that have been specifically found to grow in the presence of sodium bisulfite. Fungi suitable for the present invention will partially liberate cellulose fibers from the lignin matrix of natural wood. *C. subvermispora* is a preferred species because of energy reduction in processing paper produced from *C. subvermispora*-treated chips.

Fungi are preferably applied to the wood as follows: To inoculate significant volumes of wood chips, a starter inoculum may be prepared. The starter inoculum can be simply a smaller volume of chips carrying the fungal mycelium through so that it may be conveniently mixed into a larger volume of chips for the inoculation of the larger quantity of wood chips to be subjected to the process. In the laboratory-scale procedures, an agar plate culture produced the original inoculum for seed inoculum. A seed inoculum container has soaked wood chips added to it, and has been inoculated with a sector cut from the PDA culture of the fermenting microorganism. The chips are mixed and the seed inoculum container is incubated for a time period. The time period for seed culture incubation may be between 2 weeks and 4 weeks. In the seed inoculum culture, a relatively high moisture content in the wood, at least 55%–65% is maintained to ensure better colonization of the chips with the fungal mycelia.

Alternatively, the fungal inoculum may be applied to the wood chips in other ways, such as liquid and solid inocula.

The actual incubation of the chips for fungal degradation may then proceed. The wood chips are placed in the fermentation reactor (bioreactor). The bioreactor may be any of a number of styles capable of containing solid media fermentation cultures. Though it has been found that rotating drum bioreactors host the fermentation reaction to a sufficient degree, it has also been advantageously found that stationary or static reactors work sufficiently well within the present invention to be preferred. It is merely required that the stationary or solid phase reactor have sufficient aeration so as to ensure adequate oxygen flow to the fungus and significant removal of carbon dioxide therefrom. In fact, it is an advantage of the process described herein that a stationary, and even rudimentary, reactor will suffice. Since what is required is simply some level of aeration, humidity, and temperature control, it is envisioned that simple pits or piles of chips on the ground may be utilized if aeration is provided, as by inserted tubing, and humidity is controlled, if necessary, either by containment or by moisture application.

The inoculation with the starter inoculant culture is made to the wood chips to be treated. The amount of inoculum starter culture added to the chips can vary. It required simply that it be sufficient to ensure growth and spread to all chips in the bioreactor. The starter inoculum culture chips and the chips to be treated should be thoroughly mixed and placed into the bioreactor for degradation.

The chips so inoculated will then be incubated during a time period in which the fungal mycelia will penetrate throughout the wood chips. The temperature range most desired depends on the fungal strains. It has been found that a bioreactor kept in the range of 27° C. plus or minus two degrees with a moisture content in the wood of 55%–65% plus or minus 5% achieves a degree of mycelia penetration of the wood chips that results in significant and useful degradation of the chips for paper pulping purposes. The wood chips are preferably aerated continually during the incubation period with moisture-saturated air such that the wood maintains the constant moisture content of about 55%–65%. It is most desired that the pH of the chip incubation culture be specifically monitored so that the pH stays within the broad range of between 3.0 and 6.0. Thus it is not required that pH be specifically controlled, but only monitored on occasion so that it remains within the physiological limits necessary for the growth of the fungal culture.

The time period of fungal incubation with the wood chips will vary depending on the economics of the installation. To some degree, the length of the fungal incubation will have an effect on the amount of energy saved during the subsequent mechanical refining process. In usual terms, up to certain limits, the longer the period of dwell in the incubation reactor, the less energy required for the mechanical pulping of the wood thereafter. It has been found that under the conditions used experimentally, an incubation period of four weeks results in significant modification of the wood chips and useful energy savings in the subsequent mechanical refining steps. We believe that incubation periods of as short as 10 days to 2 weeks might be useful in providing significant energy savings in a commercial-scale biopulping process. What is required to benefit from this process is only that a significant portion of the lignin in the wood is removed or modified such that the treated wood chips when pulped yield an acceptable level of energy savings compared to untreated chips. Obviously with a longer incubation period, capital costs can be higher, so although energy costs will be lower with longer incubation, economic factors may determine the length of incubation for a particular implementation.

3. Processing the Inoculated Chips

The biologically degraded wood is then mechanically pulped. Many mechanical pulping methods are suitable for the present invention.

In its simplest form, a mechanical refining process is utilized. Dilution water is added to the chips and the chips are run through a mechanical refiner in a number of sequential passes. The number of passes of the chips/pulp mixture will depend upon the freeness desired for the particular paper application to be made. Freeness is an arbitrary measure of water drainage. The chip/pulp mixture is repeatedly fed through the refiner until the desired level of freeness is achieved. Thus freeness may be periodically monitored to determine the progress of the pulps toward the freeness level which is desired for the paper. The wood pulp may be dewatered as necessary between passes. Loblolly pine, which has been incubated for a time period of four weeks with the procedures described above, requires between ten and fifteen passes to obtain the value of 100 ml Canadian standard freeness in a single disk mechanical refiner with an initial setting of 18 mils.

The overall energy efficiency of the process can be compared with that of a straight mechanical process by pulping in the same apparatus either untreated chips or treated chips while at the same time monitoring the energy consumption of the refining mill itself. The treated chips require significantly less energy input through the refiner to achieve the same level of freeness in the resulting pulps.

The biomechanical pulps made through this procedure may then be made into paper using standard papermaking techniques. Standard techniques (as described by the Technical Association of the Pulp and Paper Industry, TAPPI), which are known to work with mechanically refined pulps, work equally well with biomechanically refined pulps of the type created by the process described herein. Accordingly, the paper may be made in conventional methodologies.

Paper made from the biomechanically created pulp can be compared in quality, strength and texture to that created through simple mechanical pulping. The biomechanically created pulp has significantly increased strength property. Thus, it is apparent that the process of the present invention does not sacrifice the quality or strength of the paper in order to achieve the highly desirable energy savings, but, in fact, results in a unique combination of both significant reduction in energy utilization in the process and an increase in the strength properties of the resulting paper.

The details of the process of the present invention will become more apparent from the following Examples which describe the laboratory-scale utilization of the present process and the results achieved thereby. It is understood that the scale-up from a laboratory-scale to a plant-scale process of the pulping operation described below may involve some alteration of the parameters or details of the process steps described herein. It is to be understood that the example described below, while it demonstrates the efficacy and practicability of the process of the present invention, has not been optimized for a commercial scale. Nevertheless, the experimental evidence presented makes it clear that the procedure is efficacious and efficient and enables the creation of commercial scale-procedures for implementing the general process described herein.

EXAMPLES

The Examples below summarize our attempts to establish the efficacy of pulping with sulfite salt-treated wood. The examples demonstrate that certain white-rot fungi, such as *C. subvermispora,* are not able to outcompete indigenous microorganisms. We determined that treatment of wood chips with sodium bisulfite inhibited the growth of indigenous microorganisms, but promoted the growth of white-rot fungi, such as *C. subvermispora* and *P. chrysosporium.* We also determined that paper created from pulps from sodium bisulfite-treated wood had suitable characteristics. Therefore, unsterilized wood chips could be used in biopulping.

1. Biopulping with *C. subvermispora* under sterilized and unsterilized wood conditions In our first Example, we determined whether *C. subvermispora* strain CZ-3 under unsterilized conditions could compete with indigenous microorganism on aspen wood chips. The results are presented in Table 1. We incubated the *C. subvermispora* with and without a defined medium (referred to as "treatment" in Table 1).

This fungus saved electrical energy and improved strength properties of the paper under sterilized wood conditions. With defined medium, use of the fungus saved 39% (average of two replicates) of electrical energy, improved burst index by 37% (average of two replicates), and tear index by 116% (average of two replicates) as compared to the control. Without defined medium, 38% of electrical energy was saved along with improvements in burst index (28%) and tear index (90%) as compared to the control.

TABLE 1

| Treatments | Energy Requirement (wt.h/kg O.D. chips) | Burst Index (kN/g) | Tear Index ($mNm^2/g$) |
|---|---|---|---|
| (with modified chemically defined medium) | | | |
| Control (sterilized) | 2030 | 0.86 | 1.43 |
| Treatment (sterilized) Replicate 1 | 1236 | 1.14 | 3.24 |
| Treatment (sterilized) Replicate 2 | 1233 | 1.21 | 2.95 |
| Control (unsterilized) | 2056 | 0.87 | 1.51 |
| Treatment (unsterilized) Replicate 1 | 1936 | 0.89 | 1.65 |
| Treatment (unsterilized) Replicate 2 | 1898 | 0.84 | 1.57 |
| (without defined medium) | | | |
| Control (sterilized) | 2092 | 0.85 | 1.45 |
| Treatment (sterilized) | 1305 | 1.09 | 2.75 |
| Control (unsterilized) | 1964 | 0.81 | 1.33 |
| Treatment (unsterilized) | 2025 | 0.83 | 1.47 |

These results indicated that *C. subvermispora* cannot outcompete other indigenous microorganisms because no energy savings or improvements in strength properties were observed under unsterilized wood conditions.

In order to demonstrate this conclusion in a separate procedure, aspen wood chips were soaked in water to maintain 60% moisture content of the wood. These chips were placed in two one-liter flasks. Chips in one flask were inoculated with *C. subvermispora* and incubated at 27° C. for 10–14 days. Chips in another flask were not inoculated with the fungus, but were similarly incubated.

Three chips from each flask were plated on potato dextrose agar or tryptic soy agar plates. These plates were incubated for 24 h at 27° C. All plates showed almost the same level of contaminations. Thus *C. subvermispora* did not compete with indigenous microorganisms.

2. Effect of sulfite salts on the indigenous microorganisms of unsterilized wood chips Aspen wood chips (50 g O.D. basis) were soaked in 500 ml of water containing either 0 mg, 781 mg or 1562 mg sodium bisulfite for about 1 hour at room temperature. After soaking, water was drained from the chips.

During the 1 hour soaking the chips soaked up about 31 ml of water. Therefore, the final moisture content of wood was about 61% (wet weight basis) and the final concentration of each chemical on water basis was about 0 μg/ml, 600

μg/ml and 1200 μg/ml.

Three chips were pulled randomly from each flask and plated on potato dextrose agar and tryptic soy agar plates. These plates were incubated at 27° C. for 24 or 27 h and the contaminants were visually observed.

At 600 μg/ml, 95% of the contaminants were inhibited. At 1200 μg/ml, the chemical completely inhibited all contaminants. There were no colonies on the plate.

A panel of other sulfur-containing chemicals were analyzed for their ability to inhibit the growth of indigenous microorganisms on unsterilized wood chips in the manner described above. Table 2 describes the various concentrations of these chemicals and the percent inhibition relative to control plates observed. Sodium hydrosulfite, sodium metabisulfite and sodium bisulfite successfully inhibited the growth of microorganisms.

TABLE 2

| Chemicals | Concentration (μg/ml) | Inhibition Relative to control (%) |
|---|---|---|
| Control (no chemical) | 0 | 0 |
| Sodium Thiosulfate | 600 | 0 |
| | 1200 | 0 |
| Sodium Hydrosulfite | 600 | 70 |
| (Sodium Dithionite) | 1200 | 100 |
| Sodium Sulfite | 600 | 0 |
| | 1200 | 0 |
| Sodium Sulfate | 600 | 0 |
| | 1200 | 0 |
| Sodium meta-Bisulfite | 600 | 100 |
| | 1200 | 100 |
| Sodium Tetrathionate | 600 | 0 |
| | 1200 | 0 |
| Sodium Bisulfite | 600 | 95 |
| | 1200 | 100 |

Because sodium bisulfite inhibited all wood contaminants, we wondered whether sodium bisulfite at similar concentrations would have any adverse effect on the growth of *C. subvermispora*. If not, this chemical could be used during biopulping of unsterilized wood chips with *C. subvermispora* and other white-rot fungi.

3. Biopulping of sodium bisulfite-treated aspen wood chips with *C. subvermispora* without the addition of nutrients In this Example, we treated unsterilized wood chips with sodium bisulfite and determined whether *C. subvermispora* would perform its biopulping function. The wood chips used were aspen wood chips obtained from aspen logs harvested in the Nicolet National Forest of Wisconsin. The logs were debarked and chipped to pieces of about ¼ of an inch. The chips were bagged in plastic bags and frozen until used to prevent the growth of contaminating microorganisms.

We used a *C. subvermispora* CZ-3 culture which had been continuously maintained on potato dextrose agar slants. Working cultures were prepared from the stock cultures via standard methods as needed and refrigerated until used. Potato dextrose agar plate culture was inoculated from a working culture and incubated at 27° C. and 65% relative humidity for 10 days.

To prepare a liquid inoculum of *C. subvermispora*, potato dextrose broth (43.20 g) and yeast extract (13.08 g) were added to 1800 ml of distilled water and mixed well. 300 ml of this medium was poured into six 2800-ml flasks. Each flask was autoclaved for 20 min. at 121° C. After cooling to room temperature, each flask was inoculated with 30 plugs cut into 13-mm diameter plugs from a 10-day old fungal culture on a potato dextrose agar plate. The flasks were then incubated at 27° C. at 65% relative humidity for 10–15 days. Prior to use, the flasks containing the fungal biomass were decanted and washed with sterile distilled water to remove excess medium from the fungus. The fungal biomass was then placed in distilled water and blended in a Waring blender (VWR scientific) twice for 15 seconds each time at high speed, following which distilled water was added to the suspension to make the total volume 500 ml. About 100 grams of this suspension (2.61 g dry weight) was added to each bioreactor containing about 1600 grams of aspen chips measured on a dry weight basis prepared as described below. The blended mycelium was dumped onto the chips and mixed.

Three batches of aspen wood chips were prepared, each batch containing 1800 g dry weight of chips. One batch was soaked in 18 kg of water containing no sodium bisulfite. A second batch was soaked in 18 kg of water containing 28.125 g of sodium bisulfite. A third batch was soaked in 18 kg of water containing 56.250 g of sodium bisulfite. After the chips had soaked, we performed our experiments on 1600 g of chips (dry weight basis). The soaking was done at room temperature for about 1 hour. After soaking, water or sodium bisulfite solution was drained through a mesh. Based on the amount of water or sodium bisulfite solution absorbed by the chips, we calculated that 1600 g dry weight of chips retained about 600 or 1200 μg/ml of sodium bisulfite. Thus, there were three treatments: 1) chips without sodium bisulfite (water only), 2) chips containing 600 μg/ml of sodium bisulfite, and 3) chips containing 1200 μg/ml of sodium bisulfite.

Bioreactors containing soaked chips were left at room temperature for 48 h. U.S. Pat. No. 5,055,159 describes a suitable bioreactor. (U.S. Pat. No. 5,055,159 is hereby incorporated by reference.) Prior to inoculation, chips were pulled out from these bioreactors and plated on potato dextrose and tryptic soya agar plates to measure the contaminants level. These plates were incubated at 27° C. and 65% relative humidity for 24 h. Chips that had been soaked in 1200 μg/ml sodium bisulfite solution had no endogenous microorganisms, just as we observed in the previous experiment.

The inoculum and large batches of chips prepared as above were mixed thoroughly. After mixing, the chips were then fermented in the bioreactors at 27° C. for 2 weeks. At harvest, chips were refined in a 300-mm diameter mechanical atmospheric single disk refiner and paper was made from the pulps thus created (Akhtar et al., *Tappi J.*, 75:105–109, 1992).

At harvest, fungus-treated chips with and without sodium bisulfite soaking were plated on potato dextrose and tryptic soya agar plates to determine the contaminants level. These plates were incubated at 27° C. and 65% relative humidity for 72 h. Fungus-treated chips without sodium bisulfite showed heavy contamination, whereas fungus-treated chips with sodium bisulfite showed almost no contamination. Moreover, fungus-treated chips with sodium bisulfite showed heavy growth of *C. subvermispora*. Other results are summarized in Table 3. High level of sodium bisulfite (1200 μg/ml) caused only 1.7% wood loss, saved 18.4% of electrical energy, improved tear index by 15%, and fiber length by 26% as compared to the control. Low (600 μg/ml) and zero levels of sodium bisulfite showed only slight effects in these parameters.

TABLE 3

| Treatments | Weight loss (%) | Cumulative energy (wt.h/kg) | Burst index (kN/g) |
|---|---|---|---|
| Control | — | 2148 | 1.13 |
| Treatment (0 μg/mlBiS) | 0 | 2175 | 1.15 |
| Treatment (600 μg/mlBiS) | 0 | 2026 | 1.10 |
| Treatment (1200 μg/mlBiS) | 1.7 | 1752 | 1.11 |

| Treatments | Tear index ($mNm^2/g$) | Fiber length (mm) |
|---|---|---|
| Control | 2.32 | .53 |
| Treatment (0 μg/mlBiS) | 2.22 | .56 |
| Treatment (600 μg/mlBiS) | 2.26 | .54 |
| Treatment (1200 μg/mlBiS) | 2.67 | .67 |

BiS = Bisulfite

We repeated the experiment described above with a four-week incubation. Four batches of aspen wood chips were prepared, each batch containing 3600 g dry weight of chips. One batch was soaked in 36 kg of water containing no sodium bisulfite. Second, third and fourth batches each were soaked in 36 kg of water containing 112.50 g of sodium bisulfite at room temperature for about 1 hour. After soaking, water or sodium bisulfite solution was drained through a mesh. Based on the amount of water or sodium bisulfite solution soaked, we calculated that each batch of 1600 g dry weight of chips retained about 1300 μg/ml of sodium bisulfite. Bioreactors containing soaked chips were left at room temperature for 48 h. The following eight treatments were made:

Control 1: Chips without sodium bisulfite (water only), without autoclaving, and without a fungal pretreatment.

Control 2: Chips containing 1300 μg/ml of sodium bisulfite, without autoclaving, and without a fungal pretreatment.

Control 3: Chips without sodium bisulfite (water only), with autoclaving for 90 min. at 121° C., and without a fungal pretreatment.

Control 4: Chips containing 1300 μg/ml of sodium bisulfite, with autoclaving for 90 min. at 121° C., and without a fungal pretreatment.

Treatment 1: Chips without sodium bisulfite (water only), without autoclaving, but inoculated with the fungus.

Treatment 2: Chips containing 1300 μg/ml of sodium bisulfite, without autoclaving, but inoculated with the fungus.

Treatment 3: Chips without sodium bisulfite (water only), with autoclaving for 90 min. at 121° C., but inoculated with the fungus.

Treatment 4: Chips containing 1300 μg/ml of sodium bisulfite, with autoclaving for 90 min. at 121° C., but inoculated with the fungus.

Prior to inoculation, chips were pulled out from the bioreactors and plated on potato dextrose and tryptic soya agar plates to determine the contaminants level. These plates were incubated at 27° C. and 65% relative humidity for 24 h. Chips soaked in sodium bisulfite solution completely inhibited microorganisms, as was seen in the previous experiment.

The inoculum and large batches of chips prepared as above were mixed thoroughly. After mixing, the chips were then fermented in the bioreactors at 27° C. for 4 weeks. At harvest, chips were refined in an atmospheric refiner and paper was made from the pulps thus created.

At harvest, fungus-treated chips with and without sodium bisulfite soaking were plated on potato dextrose and tryptic soya agar plates to determine the contaminants level. These plates were incubated at 27° C. and 65% relative humidity for 72 h. Fungus-treated chips without sodium bisulfite showed heavy contamination, whereas fungus-treated chips with sodium bisulfite showed almost no contamination. Moreover, fungus-treated chips with sodium bisulfite showed heavy growth of *C. subvermispora.*

Results are summarized below in Table 4. Fungal pretreatment with sodium bisulfite caused only 1.2–5.3% wood loss, and saved substantial amount of electrical energy (32–38%). Sodium bisulfite under unsterilized wood conditions (treatment 2) increased tear index by 45% and fiber length by 37% as compared to the control (control 2). This treatment (treatment 2) did not increase the burst index. Sodium bisulfite under sterilized wood conditions (treatment 4) increased burst index by 19%, tear index by 63%, and fiber length by 43%, as compared to the control (control 4).

TABLE 4

| Treatments | Weight loss (%) | Cumulative energy (wt.h/kg) | Burst index (kN/g) |
|---|---|---|---|
| Control 1 (not A/C, 0 μg/ml BiS) | — | 2046 | 1.14 |
| Control 2 (not A/C, 1300 μg/ml BiS) | — | 2034 | 1.07 |
| Control 3 (A/C, 0 μg/ml BiS) | — | 2134 | 1.14 |
| Control 4 (A/C, 1300 μg/ml BiS) | — | 2043 | 1.14 |
| Treatment 1 (not A/C, 0 μg/ml BIS) | 0 | 2062 | 1.10 |
| Treatment 2 (not A/C, 1300 μg/ml BiS) | 1.2 | 1392 | 1.14 |
| Treatment 3 (AC, 0 μg/ml BiS) | 4.1 | 1423 | 1.25 |
| Treatment 4 (A/C, 1300 μg/ml BiS) | 5.2 | 1249 | 1.36 |

| Treatments | Tear Index ($mNm^2/g$) | Fiber Length (mm) |
|---|---|---|
| Control 1 (not A/C, 0 μg/ml BiS) | 1.86 | .57 |
| Control 2 (not A/C, 1300 μg/ml BiS) | 2.07 | .59 |
| Control 3 (A/C, 0 μg/ml BiS) | 2.11 | .58 |
| Control 4 (A/C, 1300 μg/ml BiS) | 2.09 | .60 |
| Treatment 1 (not A/C, 0 μg/ml BiS) | 2.19 | .59 |
| Treatment 2 (not A/C, 1300 μg/ml BiS) | 3.01 | .81 |
| Treatment 3 (A/C, 0 μg/ml BiS) | 3.12 | .78 |
| Treatment 4 (A/C, 1300 μg/ml BiS) | 3.40 | .86 |

A/C: Autoclaved
BiS: Bisulfite

4. Evaluation of Effluent

Environmental guidelines restrict the composition of effluents from the various stages of pulping and paper making. Untreated effluent streams from pulping generally are detrimental to aquatic life. To meet quality standards for discharge, mills are equipped with treating facilities to assure compliance with the Environmental Protection Agency (EPA) regulations. A legitimate concern about introducing new pulping techniques is whether the treatment system already in place could accommodate the waste load produced by a new process. Ideally, a new process should be more environmentally compatible than existing processes.

Evaluating biopulp effluents is an important factor in assessing the feasibility of this new pulping process. Biopulping might produce some fungal metabolites or other byproducts that could significantly alter the waste loads currently produced by mechanical pulping methods. Because the composition of biopulp effluent is unknown, we selected a general toxicity test method, Microtox, as an appropriate method for the evaluation. Microtox analysis has been used satisfactorily as a rapid screening method for evaluating toxicity of pulp mill effluents Firth, B. and Backman, C. *Tappi J.*, 75[12]169; 1991.

For each run, approximately 1.5–1.6 kg wood chips (oven dry weight basis) of each treatment from 4-week incubation samples, were fiberized in an atmospheric refiner and the pulp slurry was collected in 20-gallon plastic containers. The flow rate during refining operation was approximately 50 kg 90° C. water per kg chips (oven dry weight basis). A representative 5-gallon sample was taken from each slurry and filtered on a Buchner funnel to separate pulp from effluent (filtrate). Filtrates were cooled to 4° C. and pH was recorded. Chilled effluent samples were submitted for Microtox testing at National Council for Air and Stream Improvement according to standard Microtox procedures.

Effluent toxicity data are presented in Table 5. Autoclaved controls with (control 4) and without (control 3) sodium bisulfite, and not-autoclaved control with sodium bisulfite (control 2) showed high effluent toxicity as compared to the not-autoclaved control without sodium bisulfite (control 2). Although sodium bisulfite pretreatment increased effluent toxicity of the non-autoclaved control chips (control 2), it produced the least toxic effluent from biopulp (treatment 2).

TABLE 5

Effluent toxicity of the control and the fungus-treated chips with and without sodium bisulfite pretreatment after 4-week incubation

| Treatments (100/EC50) | Toxicity Units |
|---|---|
| Control 1 (not A/C, 0 μg/ml BiS) | 7.9 |
| Control 2 (not A/C, 1300 μg/ml/BiS) | 15.4 |
| Control 3 (A/C, 0 μg/ml BiS) | 22.7 |
| Control 4 (A/C, 1300 μg/ml BiS) | 16.1 |
| Treatment 1 (not A/C, 0 μg/ml BiS) | 5.8 |
| Treatment 2 (not A/C, 1300 μg/ml BiS) | 4.2 |
| Treatment 3 (A/C, 0 μg/ml BiS) | 7.8 |
| Treatment 4 (A/C, 1300 μg/ml BiS) | 6.2 |

A/C = Autoclaved
Bis = Bisulfite

5. Effect of sodium bisulfite on the growth of white-rot fungi

We determined whether sodium bisulfite increases the growth of the desired microorganisms. If so, sodium bisulfite could be used to increase fungal biomass (inoculum potential) and help isolate desired organisms from contaminated substrates such as wood or soil.

In order to demonstrate the effect of sodium bisulfite, we prepared modified chemically defined medium with different levels of sodium bisulfite (0–1000 μg/ml). 2% agar was added to the medium. The medium was autoclaved for 15 min. and the medium was poured into petri dishes. These plates were then inoculated with a plug cut into 8-mm diameter plugs from a petri dish containing a 5-day-old culture of *P. chrysosporium* or a petri dish containing a 10-day-old culture of another white-rot fungi. *P. chrysosporium*-inoculated plates were incubated at 39° C. Plates inoculated with other fungi were incubated at 27° C.

Sodium bisulfite at 250 or 500 μg/ml increased the radial growth of *P. chrysosporium* at both 24 and 36 h of incubation (Table 6). Dry weight of the fungus also was increased with these levels of sodium bisulfite. Treatment of chips with any sulfite salt that inhibits the growth of indigenous microorganisms but permits the growth of white-rot fungi would be suitable for the present invention.

TABLE 6

Effect of sodium bisulfite on the radial growth and mycelial dry weight of *Phanerochaete chrysosporium* BKM-F-1767

| Sodium Bisulfite | Radial Growth (cm) | | Mycelial Dry Weight (mg) |
|---|---|---|---|
| (μg/ml) | 24 h ± SD | 36h ± SD | 36 ± SD |
| 0 | 4.05 ± .27 | 7.25 ± .36 | 19 ± 6 |
| 100 | 4.30 ± .26 | 7.52 ± .27 | 21 ± 3 |
| 250 | 5.16 ± .28 | 8.62 ± .20 | 39 ± 8 |
| 500 | 5.07 ± .25 | 8.68 ± .09 | 36 ± 6 |
| 1000 | 1.15 ± .22 | 2.88 ± .42 | 10 ± 2 |

Sodium bisulfite at 500 μg/ml also increased the radial growth of the white-rot fungi listed in Table 7 when tested at 72 and 96 h of incubation.

TABLE 7

Effect of sodium bisulfite on the radial growth of other white-rot fungi

| | Radial growth (cm) | | | |
|---|---|---|---|---|
| | 72h ± SD | | 96h ± SD | |
| Sodium bisulfite (μg/ml) | 0 | 500 | 0 | 500 |
| Fungi | | | | |
| *P. tremellosa* PRL-2845 | 0 ± 0 | 1.73 ± .06 | 0 ± 0 | 2.97 ± .12 |
| *P. brevispora* 7030-sp | 1.03 ± .06 | 2.23 ± .06 | 1.73 ± .12 | 4.07 ± .38 |

TABLE 7-continued

Effect of sodium bisulfite on the radial growth of other white-rot fungi

| | Radial growth (cm) | | | |
|---|---|---|---|---|
| | 72h ± SD | | 96h ± SD | |
| *P. subserialis* RLG-6074-sp | 3.07 ± .11 | 3.93 ± .42 | 5.23 ± .35 | 7.07 ± .29 |
| *H. setulosa* FP-106976-sp | 1.07 ± .12 | 1.97 ± .06 | 1.53 ± .06 | 3.77 ± .25 |
| *C. subvennispora* strains: | | | | |
| FP-90031-sp | 1.73 ± .23 | 3.20 ± .20 | 2.80 ± .46 | 5.77 ± .31 |
| L-6133-sp | 1.13 ± .15 | 2.37 ± .25 | 1.89 ± .12 | 4.80 ± .20 |
| CZ-3 | 0 ± 0 | 2.37 ± .12 | 1.37 ± .25 | 4.37 ± .15 |
| FP-105752-sp | 1.23 ± .15 | 2.13 ± .06 | 1.60 ± .10 | 4.00 ± 00 |
| L-14807-sp | 0 ± 0 | 2.60 ± .30 | 1.23 ± .12 | 5.07 ± .31 |
| L-15225-sp | 1.17 ± .15 | 1.63 ± .40 | 2.10 ± .46 | 4.20 ± .72 |
| FP-104027-T | 2.07 ± .38 | 3.63 ± .23 | 3.27 ± .46 | 6.07 ± .46 |

OVERALL CONCLUSIONS

Sodium bisulfite at least at 2–2.5 kg/ton of wood chips (oven dry weight basis) without any nutrient additive produced stronger mechanical pulps from unsterilized wood chips with much less electrical energy requirement and less toxicity than from control chips. Sodium bisulfite treatment of chips would therefore obviate the requirement for sterilization of wood chips before biopulping. Treatment of chips with any sulfite salt that inhibits the growth of indigenous microorganisms but permits the growth of white-rot fungi would be suitable for the present invention.

We claim:

1. A method for producing paper comprising the steps of:

(a) treating wood chips with an amount of sulfite salt sufficient to inhibit indigenous microorganism growth wherein the sulfite salt is one that inhibits the growth of indigenous microorganisms but permits white-rot fungi to grow;

(b) introducing the wood chips into a bioreactor;

(c) inoculating the wood chips in the reactor with a starter inoculum of *Ceriporiopsis subvermispora* fungus; wherein step (c) is after step (a) and an amount of said sulfite salt sufficient to encourage the growth of *Ceriporiopsis subvermispora* fungus remains in the treated chips;

(d) incubating the wood chips under conditions favorable to the propagation of the fungus through the wood chips;

(e) mechanically pulping the incubated wood chips to a selected level of freeness of fibers in the pulp; and (f) making paper with the pulp so produced.

2. A method of making a wood pulp comprising the steps of:

(a) chipping wood into wood chips;

(b) treating the wood chips with an amount of sulfite salt sufficient to inhibit indigenous microorganism growth, wherein the sulfite salt is one that inhibits the growth of indigenous microorganisms but permits the heavy growth of white-rot fungi;

(c) introducing the treated wood chips into a bioreactor;

(d) inoculating the wood chips with an inoculum including a viable culture of *Ceriporiopsis subvermispora* fungus, wherein step (d) takes place after step (b) and an amount of said sulfite salt sufficient to permit the growth of *Ceriporiopsis subvermispora* fungi remains in the treated chips;

(e) incubating the wood chips under conditions favoring the propagation of the fungus through the wood chips for a sufficient amount of time for the fungus to modify a significant amount of the lignin naturally present in the wood chips; and (f) mechanically pulping the wood chips degraded by the fungus into a paper pulp.

3. The method of claim 2 wherein the wood chips are obtained from southern yellow pine.

4. The method of claim 2 wherein the wood chips are obtained from aspen.

5. The method of claim 2 wherein the *Ceriporiopsis subvermispora* is strain CZ-3.

6. The method of claim 2 wherein the sulfite salt is selected from the group consisting of sodium hydrosulfite, sodium meta-bisulfite and sodium bisulfite.

7. The method of claim 6 wherein the sulfite salt is sodium bisulfite.

* * * * *